US006641468B2

(12) United States Patent
Lien et al.

(10) Patent No.: US 6,641,468 B2
(45) Date of Patent: Nov. 4, 2003

(54) SLURRY DISTRIBUTOR

(75) Inventors: Chien-Ping Lien, Kaohsiung (TW); Ching-Feng Tsai, Hsinchu (TW)

(73) Assignee: Promos Technologies Inc, Hsinchu (TW)

( * ) Notice: Subject to any disclaimer, the term of this patent is extended or adjusted under 35 U.S.C. 154(b) by 9 days.

(21) Appl. No.: 10/091,943

(22) Filed: Mar. 5, 2002

(65) Prior Publication Data

US 2003/0171080 A1 Sep. 11, 2003

(51) Int. Cl.[7] ..... B24B 57/00
(52) U.S. Cl. ..... 451/446; 451/60
(58) Field of Search ..... 451/60, 446, 28, 451/36, 285, 287, 288

(56) References Cited

U.S. PATENT DOCUMENTS 5,738,573 A * 4/1998 Yueh ..... 451/287
5,921,849 A * 7/1999 Kim et al. ..... 451/60
6,116,993 A * 9/2000 Tanaka ..... 451/287
6,179,699 B1 * 1/2001 Costa ..... 451/446
6,284,092 B1 * 9/2001 Manfredi ..... 156/345.12

* cited by examiner

*Primary Examiner*—Dung Van Nguyen
(74) *Attorney, Agent, or Firm*—J.C. Patents

(57) ABSTRACT

A slurry distributor having a base section, a main body section, a distributing structure (sidewall section) and a connecting structure. The main body section is above the base section and the distributing structure is above the main body section. The distributing structure accommodates one or more types of slurry, mixes up the different slurry types and channels out the well-mixed slurry. The distributing structure also has a plurality of holes close to the main body section. The connecting structure is inside the base section for engaging with a chemical-mechanical polishing installation.

13 Claims, 3 Drawing Sheets

SLURRY DISTRIBUTOR

BACKGROUND OF THE INVENTION

1. Field of Invention

The present invention relates to a chemical-mechanical polishing (CMP) device. More particularly, the present invention relates to a slurry distributor.

2. Description of Related Art

In semiconductor manufacturing, surface planarization is a major step before conducting any high-density photolithographic processes. To transfer conductive line pattern in a photo-exposure operation accurately, light dispersion must be minimized as much as possible. The only way to reduce dispersion is to remove as much surface roughness from the surface of a wafer as possible.

The most common techniques for planarizing wafer surface include spin-on-glass (SOG) and chemical-mechanical polishing (CMP). However, as semiconductor manufacturing progresses into the sub-half-micron line width range, spin-on-glass no longer can attain the level of surface planarity desired. Consequently, chemical-mechanical polishing has almost become the sole means for providing the level of planarity required to manufacture very large scale integration (VLSI) and ultra large scale integration (ULSI) chips. Since chemical-mechanical polishing is an anisotropic polishing process, the process is able not only to planarize a wafer surface globally but also to fabricate vertical and horizontal interconnects of a damascene structure. In addition, CMP can also be applied to fabricate shallow trench isolation structures or other advanced devices, planarize micro-electromechanical systems and manufacture flat display panels.

In general, chemical-mechanical polishing utilizes mechanical abrasion to remove surface material. To conduct a wafer polishing operation, the polishing table and the wafer carrier of a chemical-mechanical polishing system each rotates in fixed direction. The wafer carrier grips the backside of a wafer and presses the front surface of the wafer against a polishing pad on the polishing table. In the meantime, slurry is continuously supplied to the polishing pad. When bumps on the surface of the wafer contact the polishing pad, chemical agents within the slurry will react with bump material while abrasive particles within the slurry enhance mechanical abrasion so that the bumps are gradually removed. Continuous application of the chemical reaction and mechanical abrasion ultimately produces a highly planar surface. If various polishing factors are properly controlled, a chemical-mechanical polishing operation may produce a surface planarity up to 94% or higher.

In chemical-mechanical polishing, the quality of slurry has a leading role in the stability of the process. Since slurry is normally concentrated for ease of packaging, the slurry must be diluted by using a solvent before actual use on the polishing table. Because the rate of chemical reaction depends on the chemical agents inside the slurry and the polishing condition depends on the state of abrasive particles, different type of slurry is used to polish different material surface. Typically, two or more types of slurry are used singly or alternatively in a surface planarization operation.

A conventional chemical-mechanical polishing system has a mixer for mixing up chemical ingredient in-situ so that two or more types of slurry are supplied to the polishing pad when required. However, due to brief mixing of chemical ingredients in an in-situ process, quality of the slurry often varies. Furthermore, slurry is distributed to various locations on the polishing pad during a chemical-mechanical polishing operation. Hence, the slurry is not distributed uniformly over the entire surface of the polishing pad. Since a non-uniform distribution of slurry may affect the polishing rate and polishing uniformity of the wafer surface, quality and performance of the polishing operation is very much compromised.

A conventional slurry distributor is disclosed in U.S. Pat. No. 5,921,849. FIG. 1A is a top view of the conventional slurry distributor. FIG. 1B is a side view of the conventional slurry distributor and FIG. 1C is a cross-sectional view along line I–I' of the conventional distributor as shown in FIG. 1A.

As shown in FIGS. 1A to 1C, the slurry distributor 100 has a truncated conical shape. The distributor 100 includes a base section 102 and a main body section 104. A groove 106 is formed in the interior of the main body section 104. The groove 106 mainly serves as a slurry accumulator and a reservoir for mixing up the slurry ingredients before distribution. The main body section 104 also has six rectangular pipelines 108. Each pipeline 108 is formed on the upper edge of the groove 106. All pipelines 108 are in connection with the groove 106 so that the accumulated slurry within the groove 106 may flow to the polishing pad via the pipelines 108. In addition, the base section 102 of the slurry distributor 100 has a concave opening 110 for connecting to a lapping wheel (not shown) on the chemical-mechanical polishing table.

To use the slurry distributor 100 in a chemical-mechanical polishing operation, both the slurry distributor 100 and the lapping wheel rotate around an axle. Two or more types of slurry are fed to the distributor 100 and mixed within the groove 106 due to axial rotation of the distributor 100. The mixed slurry flows out of the groove 106 through the pipelines 108 and drops to the polishing pad surface from the edge of the main body 104.

However, the aforementioned chemical-mechanical polishing system has at least the following drawbacks. When different types of slurry are fed to the groove 106 of the distributor 100, some of the slurry may splash over leading to unwanted pollution of surrounding sensors. Ultimately, these sensors may lose their wafer monitoring function causing a drop in wafer yield. Furthermore, if the slurry is not completely flushed away by incoming solvent, some of the abrasive particles may accumulate inside the groove 106 and produce non-uniformly mixed slurry. The inability to supply uniformly mixed slurry to each wafer carrier of a multi-head polishing device renders the slurry distributor unsuitable for providing slurry to the polishing pad of a multi-head polishing system. In addition, if the slurry supply pipelines converge upon a point slightly off center from the center of the slurry distributor 100, different polishing head may receive a slightly different version of the slurry. Consequently, uniform polishing of each wafer is impossible.

SUMMARY OF THE INVENTION

Accordingly, one object of the present invention is to provide a slurry distributor for mixing up different types of slurry and distributing the well-mixed slurry evenly over a polishing pad.

A second object of this invention is to provide a slurry distributor capable of preventing inappropriate out-splashing that may pollute surrounding devices.

To achieve these and other advantages and in accordance with the purpose of the invention, as embodied and broadly described herein, the invention provides a slurry distributor. The distributor comprises a base section, a main body section, a distributing structure (a sidewall section) and a connecting structure. The distributing structure (the sidewall section) mounts on top of the main body section for accommodating one or more types of slurry, mixing up the different types of slurry and permitting the well-mixed slurry to flow out evenly. The distributing structure also includes a plurality of holes near the main body section. The connecting structure is formed within the base section for linking up with a chemical-mechanical polishing device.

The slurry distributor according to this invention has a distributing structure (sidewall section). The distributing structure is able to prevent any out-splashing of slurry to pollute surround devices. Furthermore, the distributing structure may also serve as a buffer controlling the rate of dropping of slurry. In addition, an arch-shaped surface is formed at the lower section of the distributing structure so that abrasive particles suspended within the slurry will not accumulate inside the slurry distributor. Hence, different types of slurry are uniformly mixed to form homogenous slurry with stable quality.

The distributing structure of the slurry distributor further includes a plurality of holes near the main body section so that the distributor rotates around a spin axle. The slurry flows out through these holes and spreads out evenly on the polishing pad. Consequently, the slurry distributor of this invention can be used to delivery slurry evenly over a polishing pad having a multi-head system.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
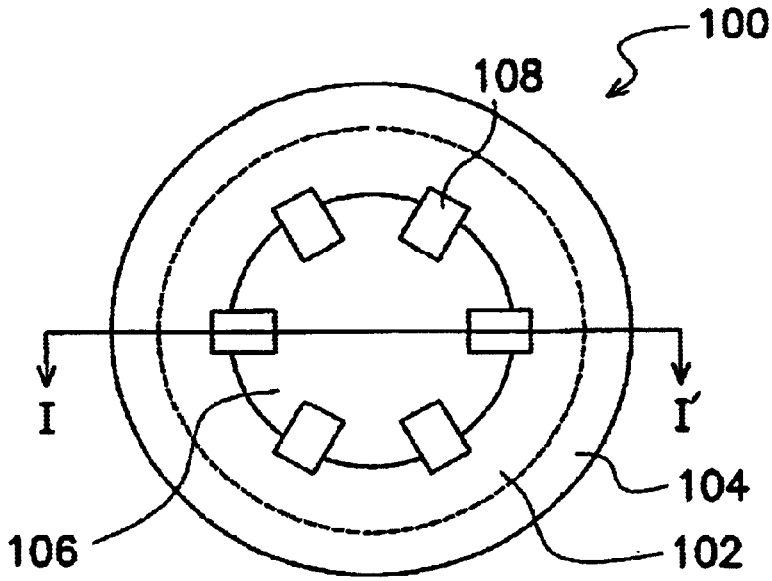
FIG. 1A (PRIOR ART)
FIG. 1A is a top view of a conventional slurry distributor.
Figure 1B:
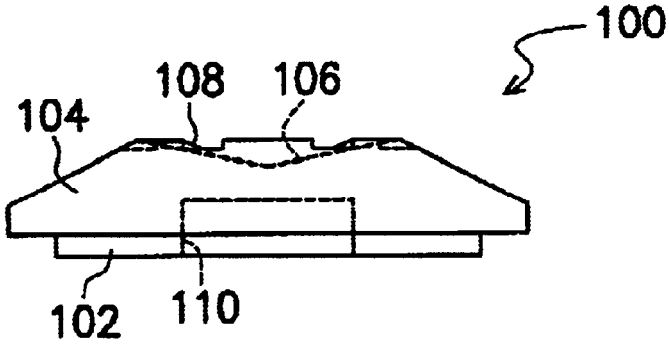
FIG. 1B (PRIOR ART)
FIG. 1B is a side view of the conventional slurry distributor.
Figure 1C:
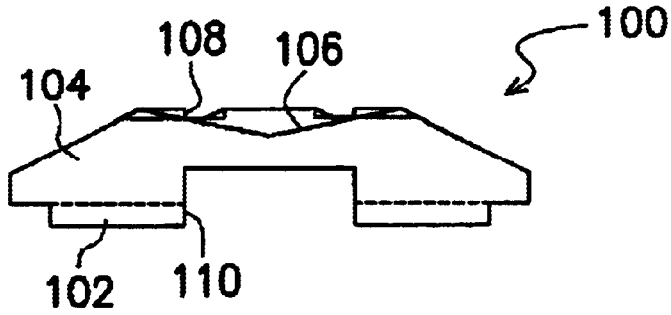
FIG. 1C (PRIOR ART)
FIG. 1C is a cross-sectional view along line I–I' of the conventional slurry distributor shown in FIG. 1A.

Reference will now be made in detail to the present preferred embodiments of the invention, examples of which are illustrated in the accompanying drawings. Wherever possible, the same reference numbers are used in the drawings and the description to refer to the same or like parts.

In this invention, a distributing structure (sidewall section) is formed on a slurry distributor to prevent any out-splashing of slurry. A plurality of holes is also formed inside the distributing structure so that slurry may flow out through these holes to provide an equal and uniform supply of slurry to a polishing pad.

Figure 2A:
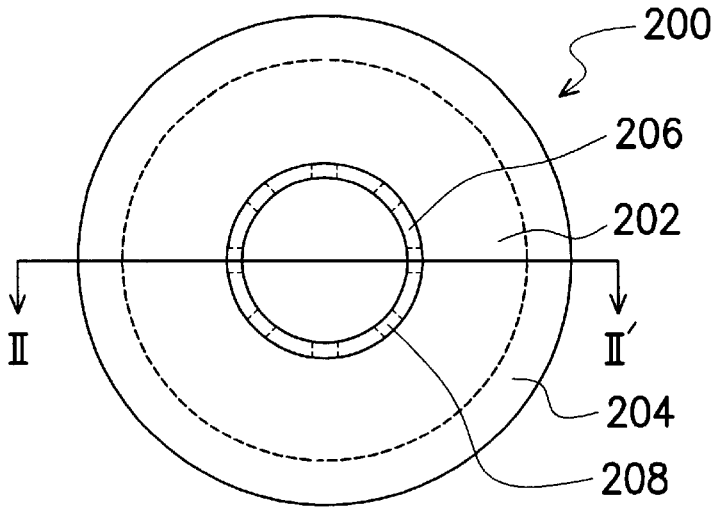
FIG. 2A is a schematic top view of a slurry distributor according to one preferred embodiment of this invention.
Figure 2B:
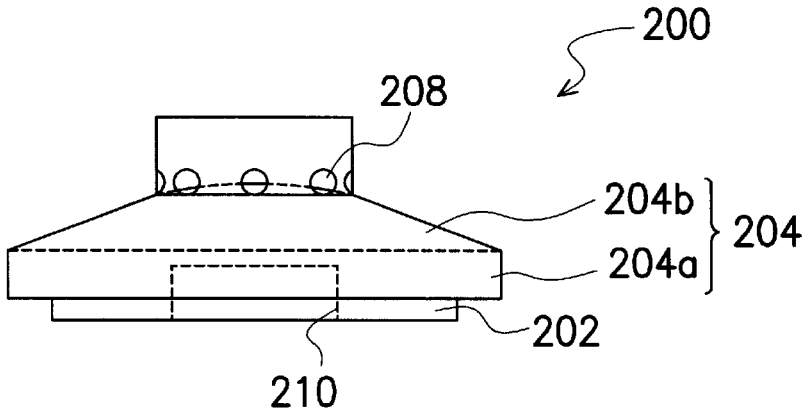
FIG. 2B is a side view of the slurry distributor as shown in FIG. 2A.
Figure 2C:
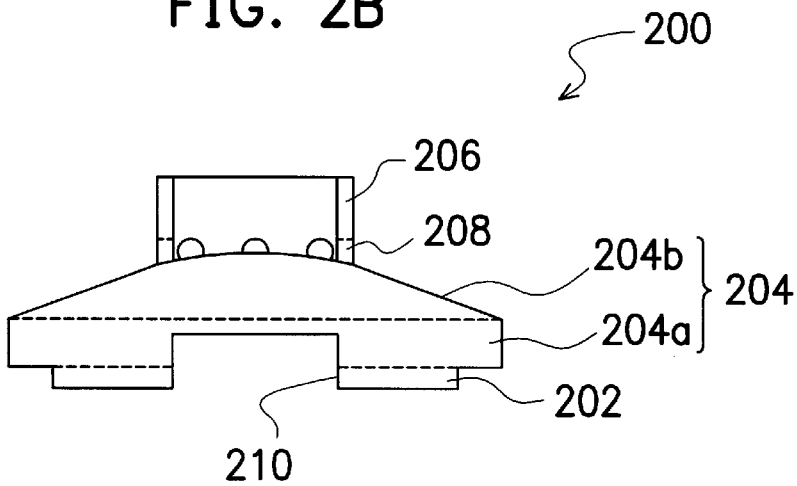
FIG. 2C is a cross-sectional view along line II–II' of the slurry distributor shown in FIG. 2A.

FIG. 2A is a schematic top view of a slurry distributor according to one preferred embodiment of this invention. FIG. 2B is a side view of the slurry distributor as shown in FIG. 2A. FIG. 2C is a cross-sectional view along line II–II' of the slurry distributor shown in FIG. 2A. As shown in FIGS. 2A to 2C, the slurry distributor 200 according to this invention comprises a base section 202, a main body section 204 and a distributing structure (sidewall section) 206. Although the slurry distributor 200 is explained as a unit with separate components, the slurry distributor 200 is actually manufactured in one piece using a single type of material. The slurry distributor 200 is preferably made from hard polymer compound such as an ethyl-aldehyde condensate.

The base section 202, for example, is a cylindrical body having a diameter of about 127 mm and height of about 6 mm. The main body 204 is above the base section 202. The main body 204 may include a lower main body section 204*a* and an upper main body section 204*b*. The lower main body section 204*b*, for example, is a cylindrical body having a diameter of about 150 mm and a height of about 14 mm. The upper main body section 204*b* has a conical shape having a lower diameter of about 150 mm and a conical height of about 17 mm. However, the upper main body section 204*b* may have the shape of a truncated cone or some other shape such as smooth hemispherical shape. The distributing structure (sidewall section) 206 is a vertical section erected above the main body section 204. The distributing structure 206, for example, has a circular ring profile capable of accommodating one or more types of slurry and mixing up the different types of slurry to produce a homogenous mixture. The distributing structure 206 has an internal diameter of about 55 mm, an external diameter of about 65 mm and a height of about 22 mm. Moreover, the distributing structure 206 has a plurality of holes 208 close to the main body section 204 for delivering slurry. These holes 208 may have a circular, rectangular or some other shape. In this particular embodiment, a total of eight holes 208 are formed around the distributing structure 206 so that each pair of neighboring holes 208 subtend a 45° angle. Obviously, the total number of holes 208 formed around the distributing structure 206 depends on actual requirements. A connecting structure for connecting to the lapping wheel (not shown) of the chemical-mechanical station is formed inside the base section 202 and the lower main body section 204*a* of the slurry distributor 200. The connecting structure can be, for example, a cavity opening 210. The cavity opening 210 has a rectangular sectional profile having a length of about 45 mm and a depth of about 15 mm, for example. Obviously, the cavity opening 210 can have a sectional profile other than rectangular such as a circular shape. Furthermore, the base section 202, the main body section 204 and the distributing structure (sidewall section) 206 are concentric and have a common center.

Figure 3:
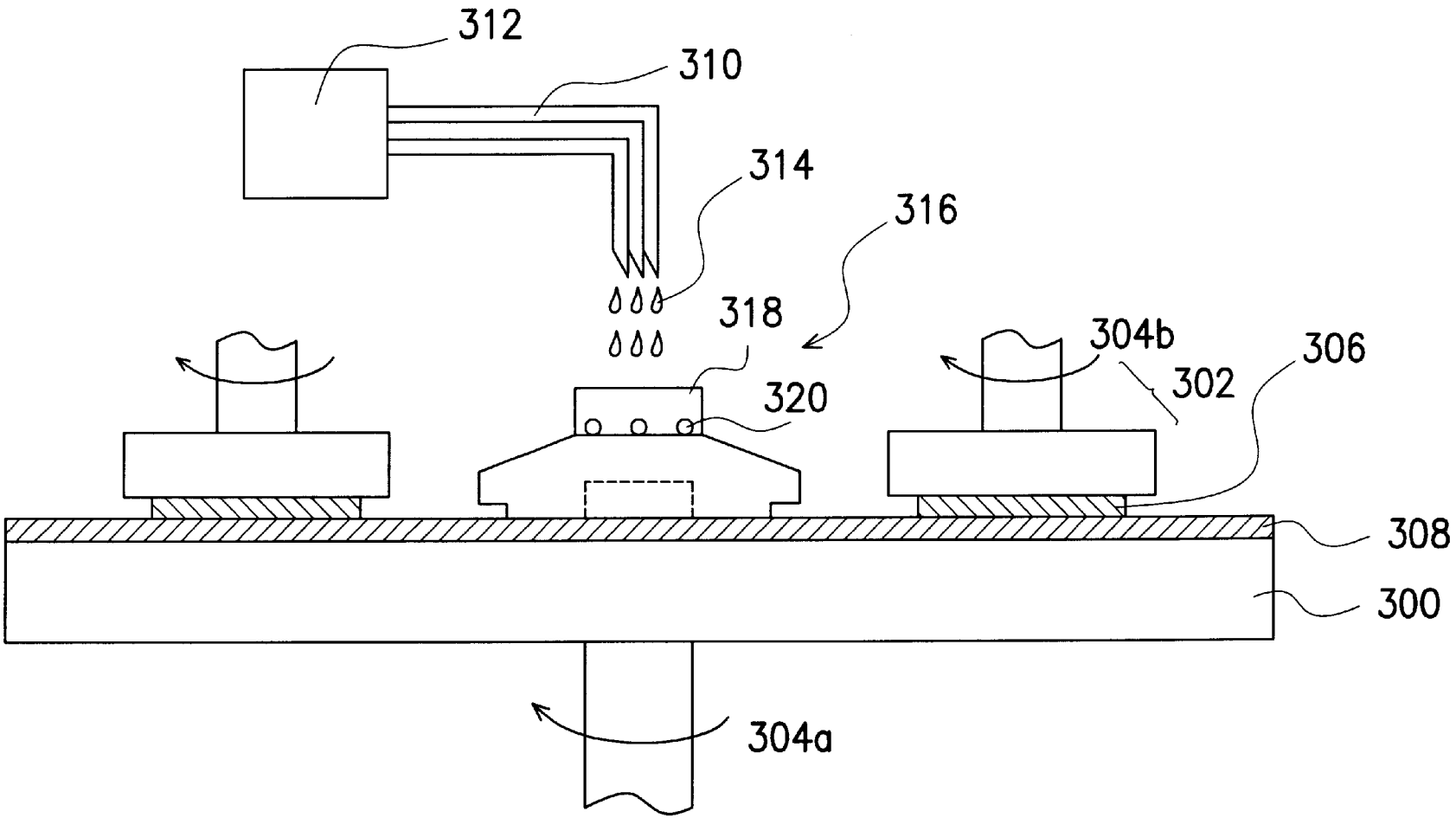
FIG. 3 is a side view of a chemical-mechanical polishing station having a slurry distributor fabricated according to one preferred embodiment of this invention.

FIG. 3 is a side view of a chemical-mechanical polishing station having a slurry distributor fabricated according to one preferred embodiment of this invention. As shown in FIG. 3, a slurry distributor 316 engages with the lapping wheel (not shown) of a chemical-mechanical polishing station. The base section of the slurry distributor 316 is in contact with the surface of a polishing pad 308. The outer edge of the slurry distributor 316 protrudes above the surface of the polishing pad 308 so that the slurry distributor may be easily dismantled from the lapping wheel.

To carry out a chemical-mechanical polishing operation, the polishing table 300 and the wafer carriers 302 in the polishing station rotate in a fixed direction as indicated by arrows 304*a* and 304*b* respectively. Each wafer carrier 302 firmly grips the backside of a wafer 306 and presses the front surface of the wafers against the polishing pad 308, Pipelines 310 leading from a supply system 312 deliver one or more types of slurry 314 to the distributor 316. Though the slurry distributor 316, well-mixed slurry is transferred to the polishing pad 308.

As slurry 314 drops into the distributing structure (sidewall section) 318 of the slurry distributor 316, the distributing structure buffers the speed of the slurry 314 and regulates the flow rate. Because the sputtered slurry 314 is blocked by the distributing structure 318, surrounding devices (such as sensors) are prevented from any unwanted pollution. Moreover, as the slurry distributor rotates around an axle, the slurry 314 is homogenized inside the distributing structure 318. The well-mixed slurry flows out through the holes 320 and moves along the outer edge of the main body section to reach the polishing pad 308. Since the slurry 314 flowing out through the holes 320 has already been homogenized and stabilized, the slurry is spread evenly over the polishing pad 308.

According to the embodiment of this invention, the slurry distributor has a distributing structure (sidewall section) that can prevent the pollution of surrounding sensors due to the out-splashing of slurry. Moreover, the distributing structure is able to buffer dropping slurry and control its rate of flow and the special arch design at the bottom of the distributing structure is able to prevent any accumulation of abrasive particles. Ultimately, the slurry distributor is able to provide a continuous supply of well-mixed and quality targeted slurry to the polishing pad.

Furthermore, the slurry distributor according to this invention has a plurality of holes in the distributing structure close to the main body section. Through rotation of the slurry distributor around an axle, the well-mixed slurry flows through the holes to deliver slurry evenly to the polishing pad. Hence, the slurry distributor is particularly suitable for supplying slurry to a multi-head polishing system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A slurry distributor, comprising:

a base section;

a main body section on top of the base section;

a distributing structure on top of the main body section for accommodating one or more types of slurry, mixing the slurry and pouring out the well-mixed slurry uniformly, wherein the distributing structure has a plurality of holes close to the main body section; and a connecting structure inside the base section for joining with a chemical-mechanical polishing device.

2. The slurry distributor of claim 1, wherein the holes are positioned evenly around the distributing structure.

3. The slurry distributor of claim 1, wherein the main body section further includes:

a lower main body section; and an upper main body section above the lower main body section.

4. The slurry distributor of claim 3, wherein the lower main body section is a cylindrical body.

5. The slurry distributor of claim 3, wherein the upper main body section is a conical body.

6. The slurry distributor of claim 3, wherein the upper main body section is a truncated conical body.

7. The slurry distributor of claim 1, wherein the distributing structure is a cylindrical ring.

8. A slurry distributor, comprising:

a base section having a cylindrical body;

a main body section above the base section, including:

a lower main body section; and an upper main body section above the lower main body section; and a sidewall section above the main body section to prevent out-splashing of slurry and channel out well-mixed slurry, wherein the sidewall section is a cylindrical ring and has a plurality of holes close to the main body section.

9. The slurry distributor of claim 8, wherein the holes are positioned evenly around the sidewall section.

10. The slurry distributor of claim 8, wherein the lower main body section is a cylindrical body.

11. The slurry distributor of claim 8, wherein the upper main body section is a conical body.

12. The slurry distributor of claim 8, wherein the upper main body section is a truncated conical body.

13. The slurry distributor of claim 8, wherein the distributor further includes a connecting structure inside the base section for joining with a chemical-mechanical polishing device.

* * * * *